US008774687B2

(12) United States Patent
Shimizu et al.

(10) Patent No.: US 8,774,687 B2
(45) Date of Patent: Jul. 8, 2014

(54) BELT DRIVING APPARATUS AND IMAGE FORMING APPARATUS

(75) Inventors: Akihiro Shimizu, Tokyo (JP); Keitaro Taoka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 13/599,184

(22) Filed: Aug. 30, 2012

(65) Prior Publication Data

US 2013/0058687 A1 Mar. 7, 2013

(30) Foreign Application Priority Data

Sep. 1, 2011 (JP) ..... 2011-190724

(51) Int. Cl.
*G03G 15/01* (2006.01)
*G03G 15/00* (2006.01)
*G03G 15/16* (2006.01)

(52) U.S. Cl.
CPC .... *G03G 15/1615* (2013.01); *G03G 2215/0016* (2013.01); *G03G 15/755* (2013.01); *G03G 2215/00151* (2013.01)
USPC ..... 399/302; 399/165

(58) Field of Classification Search
CPC ..... G03G 15/755; G03G 15/6567; G03G 2215/00561; G03G 2221/1654; G03G 2215/0016; G03G 15/1615; G03G 2215/00151; B65H 2301/331; B65G 39/071; B65G 39/16
USPC ..... 399/302, 165; 198/806, 807, 808, 198/810.01, 810.03
See application file for complete search history.

(56) References Cited

U.S. PATENT DOCUMENTS

| | | | | |
|---|---|---|---|---|
| 4,652,115 | A * | 3/1987 | Palm et al. | 399/78 |
| 6,141,526 | A * | 10/2000 | Ikeda | 399/395 |
| 6,195,108 | B1 * | 2/2001 | Kanno | 347/116 |
| 8,126,365 | B2 * | 2/2012 | Nishida et al. | 399/165 |
| 2004/0022557 | A1 * | 2/2004 | Kudo | 399/167 |
| 2007/0086813 | A1 * | 4/2007 | Takeyama | 399/302 |
| 2010/0316419 | A1 * | 12/2010 | Nakamura | 399/302 |

FOREIGN PATENT DOCUMENTS

JP 11-295948 A 10/1999

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

A belt driving apparatus includes: an endless belt having a stepped region at its edge; a driving member for driving the endless belt; a moving member for moving the endless belt in a widthwise direction; a mark provided at a part of the endless belt with respect to a circumferential direction and located at a position corresponding to the stepped region of the endless belt with respect to a rotational direction; a mark detecting member for detecting the mark during rotation of the endless belt; an edge position detecting member for detecting a widthwise position of at least one of edges of the endless belt during rotation; and a controller for controlling, after the mark detecting member detects the mark, the moving member on the basis of a detection result of the edge other than the stepped region of the endless belt.

18 Claims, 12 Drawing Sheets

BELT DRIVING APPARATUS AND IMAGE FORMING APPARATUS

FIELD OF THE INVENTION AND RELATED ART

The present invention relates to a belt driving apparatus for rotationally driving an endless belt while effecting lateral deviation (shift) control and relates to an image forming apparatus such as a copying machine a printer, a facsimile machine or a multi-function machine of these machines, including such a belt driving apparatus.

Recently, a tandem structure is widely used with speed-up of the image forming apparatus for enhancing print productivity, in which image bearing members for plural colors are arranged along an endless transfer belt, and image forming processes for the image bearing members are concurrently performed. For example, a typical example of such a belt is an intermediary transfer belt in a full-color image forming apparatus of an electrophotographic type but it has been required to inexpensively provide a technique meeting further speed-up.

In this example, the color toner images are superposedly transferred onto the intermediary transfer belt sequentially, and all the color images are transferred onto the recording material all together. The endless belt such as the intermediary transfer belt used with such a structure is stretched by a plurality of rollers and is rotationally driven.

It is generally known that the endless belt stretched by the plurality of rollers offsets toward a lateral end (lateral deviation) during travelling depending on outer diameter accuracy of the roller and/or alignment accuracy between the rollers.

With respect to such lateral deviation of the belt, lateral deviation control for controlling the lateral deviation of the belt by detecting a position fluctuation of a belt edge (widthwise end portion) and then by providing a steering roller which is one of belt inner peripheral surface holding members, with inclination is effected. This lateral deviation control has an effect in preventing belt breakage due to the offset to the limit. Further, a method in which a fluctuation of the belt with respect to a conveyance direction is detected by detecting an edge position of the belt plural times and then image formation timing is adjusted thereby to suppress also color misregistration has been proposed.

Further, in order to improve accuracy of the control, as described in Japanese Laid-Open Application (JP-A) Hei 11-295948, a method in which data of a belt edge shape is obtained and stored and then on the basis of a result of comparison between the obtained data and the stored data, the result is reflected in steering control has been proposed. The obtaining of the belt edge shape data is carried out by reading a position of a reference mark provided on a surface of the belt with respect to a circumferential direction and then by performing sampling N times per one-full-circumference of the belt in response to the detection of the reference mark.

However, in the case where the belt edge shape is detected and then the lateral deviation control of the belt is effected, there was the following problem. First, the endless belt such as the intermediary transfer belt is, in order to be manufactured at low cost, a material for the belt is molded in a length corresponding to that of a plurality of belts with respect to a belt widthwise direction and then is cut into the plurality of belts each having a length in actual use by post-processing, thus providing the plurality of belts. That is, a belt base material longer in widthwise length then the belt to be actually used is manufactured and then is cut into a plurality of belts, thus preparing the plurality of belts to be actually used.

Further, in order to ensure accuracy of the edge shape of the endless belt and accuracy of belt thickness non-uniformity of the edge portion, the belt edge portion is cut by the post-processing and then is used in some cases.

In either case, when the belt base material is cut, a cutting tool is moved relative to the belt along the circumferential direction of the belt. In this case, a deviation occurs between a cutting start position and a cutting end position, so that this portion is present, as a stepped portion, at an end portion (edge) of the belt with respect to the widthwise direction of the belt. Specifically, when the belt base material is cut, the cutting tool is contacted to the belt at a predetermined position while rotating the belt to cut the belt base material. Also during this cutting operation, the lateral deviation control of the belt is effected. For this reason, it is difficult to cause the cutting start position and the cutting end portion to coincide with each other, so that the stepped portion is generated at this portion.

In such a case where the lateral deviation control of the endless belt having the stepped portion at the edge of the endless belt is carried out on the basis of a detection result (profile) of the edge shape, there is a possibility that the stepped portion is erroneously detected and thus the lateral deviation control is not preferably effected. That is, when sampling of the belt edge is made, as shown in FIG. 15, a profile including a stepped portion D is obtained. Then, the thus-obtained profile is compared with a stored profile and then the lateral deviation control is effected depending on its difference but as shown in FIG. 16, a position of the stepped portion D is deviated between the obtained profile and the stored profile in some cases. That is, when a minute deviation is generated in the profile with time axis, also the position of the stepped portion D is detected as a deviated position in the time axis.

Thus, when the positions of the stepped portions D in the obtained profile and the stored profile are detected as the deviated positions, as shown in FIG. 17, an amplitude of the stepped portion D becomes large and correspondingly a difference between the obtained profile and the stored profile is largely detected. Further, although the difference is not large in actuality, the difference is erroneously detected that it is large. Thus, when the lateral deviation control is effected on the basis of the erroneously detected difference, the lateral deviation control is deviated from assumed control in such a manner that a degree of meandering of the belt becomes large. That is, accuracy of the lateral deviation control is lowered.

Particularly, in recent years, a rotational speed of the belt becomes fast with speed-up of the image forming apparatus, so that when the stepped portion by the belt edge cutting passes through an edge detecting sensor, a shock (impact) exerted on the sensor becomes large. For this reason, when the stepped portion by the belt edge cutting is detected, noise of the obtained shape becomes large, so that the obtained profile becomes unstable and therefore this is not preferable in the control.

In order to solve a problem of the lateral deviation control due to the presence of such a stepped portion, it would be considered that belt processing accuracy is improved in order to decrease the stepped portion. However, when the processing accuracy is improved, a manufacturing cost of the belt is inevitably increased.

Further, it would also be considered that the position of the stepped portion is identified by rotating the belt through a plurality of full circumferences and then the control is effected on the basis of the identified position. However, correspondingly to the rotation through the plurality of full circumferences, productivity of the image forming apparatus is lowered. Therefore, in either case, demands in recent years such as cost reduction of the image forming apparatus and improvement in productivity are not met.

SUMMARY OF THE INVENTION

The present invention has been accomplished in view of the above-described circumstances.

A principal object of the present invention is to provide a belt driving apparatus and an image forming apparatus which are capable of preventing a lowering in accuracy of lateral deviation control of belt caused due to presence of a stepped portion of the belt at an end portion with respect to a widthwise direction of the belt.

According to an aspect of the present invention, there is provided a belt driving apparatus comprising: an endless belt having a stepped region at its edge; a driving member for rotationally driving the endless belt; a moving member for moving the endless belt in a widthwise direction of the endless belt; a mark provided at a part of the endless belt with respect to a circumferential direction and located at a position corresponding to the stepped region of the endless belt with respect to a rotational direction of the endless belt; a mark detecting member for detecting the mark during rotation of the endless belt; an edge position detecting member for detecting a widthwise position of at least one edge of the endless belt during rotation; and a controller for controlling, after the mark detecting member detects the mark, the moving member on the basis of a detection result of the edge other than the stepped region of the endless belt.

According to another aspect of the present invention, there is provided an image forming apparatus including the belt driving apparatus.

According to the present invention, the edge position detecting member does not detect the stepped portion (stepped region) and therefore it is possible to prevent the lowering in accuracy of the lateral deviation control of the belt caused due to presence of the stepped portion of the belt at the widthwise end portion of the belt.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
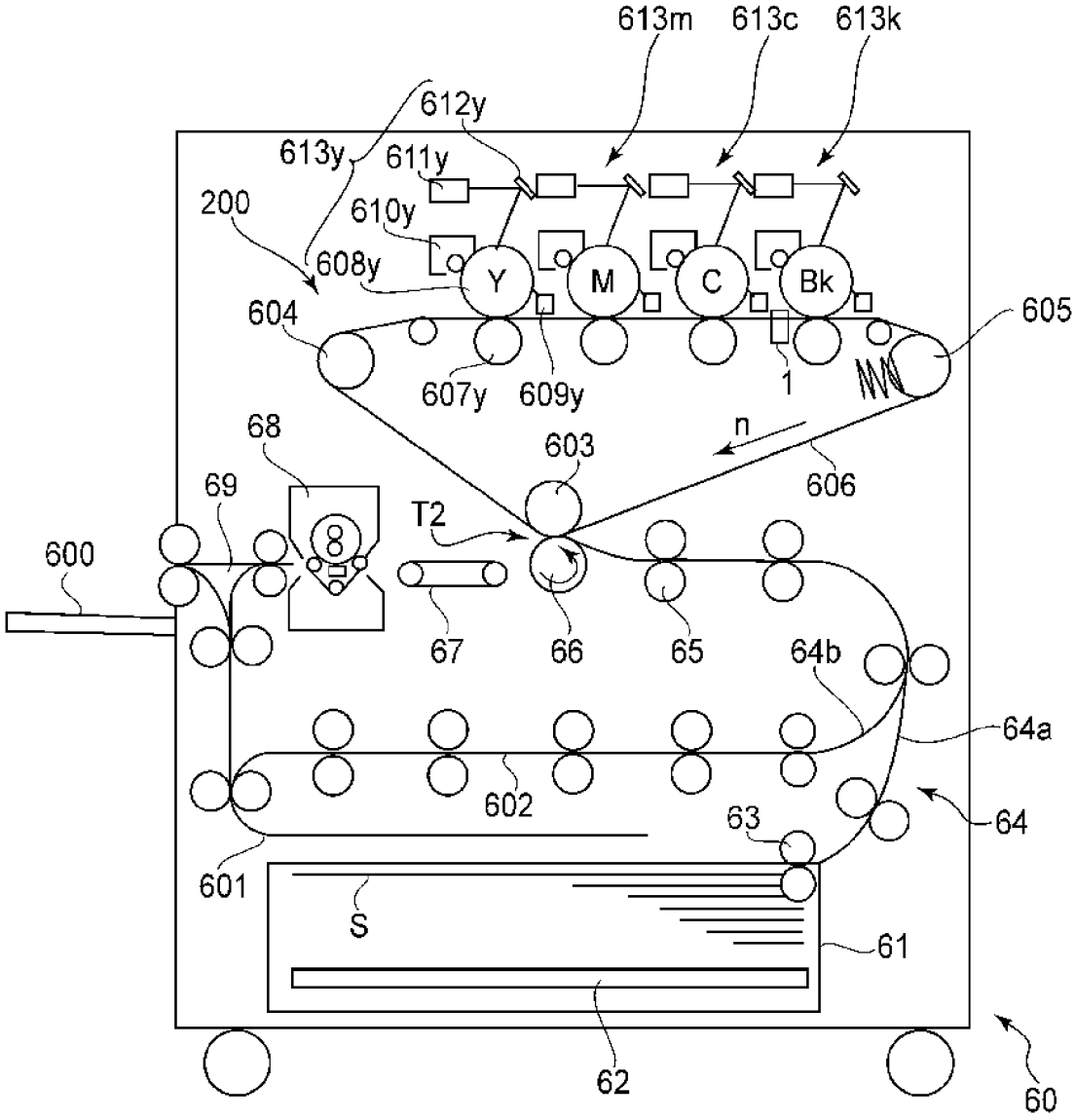
FIG. 1 is a schematic sectional view of a structure of an image forming apparatus according to an embodiment of the present invention.

Embodiments according to the present invention will be described with reference to FIGS. 1 to 14. First, with reference to FIG. 1, a general structure of an image forming apparatus according to this embodiment will be described. Incidentally, the present invention is applicable to image forming apparatuses of an electrophotographic type, an ink jet type, and the like but in this embodiment, the present invention is applied to the image forming apparatus of the electrophotographic type.

<Image Forming Apparatus>

An image forming apparatus 60 is a so-called intermediary transfer and tandem type image forming apparatus in which four color image forming portions 613*y*, 613*m*, 613*c* and 613*k* are arranged along an intermediary transfer belt 606. This type is dominant recently from the viewpoints of excellent ability to respond to thick paper and excellent productivity. In such an image forming apparatus 60, color toner images formed at the respective image forming portions 613*y*, 613*m*, 613*c* and 613*k* are superposedly transferred onto the intermediary transfer belt 606 and then are transferred from the intermediary transfer belt 606 onto a conveyed recording material S at a secondary transfer portion T2. A conveying process of this recording material S will be described.

<Conveying Process for Recording Material>

Recording materials S are accommodated on a lifting device 62 in a recording material accommodation case 61, and are fed out by a sheet feeding means 63 in timed relation with image formation. Here, the sheet feeding means 63 may be of a type using friction separation by a sheet feeding roller or the like or a type using separation and attraction by air, and in the embodiment of FIG. 1, the latter is employed.

The recording material S delivered by the sheet feeding means 63 passes on a feeding path 64*a* of the feeding unit 64 to a registration device 65. The registration device 65 carries out an inclination correction and/or a timing correction, and then, the recording material S is conveyed to a secondary transfer portion T2.

The secondary transfer portion T2 is a toner image transferring nip provided by a secondary transfer inner roller 603 and a secondary transfer outer roller 66 which are opposed to each other. The toner image is transferred from the intermediary transfer belt 606 onto the recording material S by applications of a predetermined pressure and a predetermined electrostatic load bias.

<Image Forming Process>

Concurrently with the recording material conveying process to the secondary transfer portion T2, an image forming process is carried out. An image forming station 613*y* is constituted by a photosensitive member (photosensitive drum) 608*y* as an image bearing member, an exposure device 611*y*, a developing device 610*y*, a primary transferring device 607*y*, a photosensitive member cleaner 609*y* and the like.

A surface of the photosensitive member 608*y* is uniformly charged by the charging means, and is exposed to the image light of the image information signal during rotation in the counterclockwise direction in the figure by the exposure device 611*y*, and a latent image is formed using a diffraction means 612*y* or the like. The electrostatic latent image formed on the photosensitive member 608*y* is visualized into a toner image on the photosensitive member by development with the toner by the developing device 610*y*.

Thereafter, the toner image is transferred onto the intermediary transfer belt 606 which is a travelling endless belt by the primary transferring device 607*y* with the predetermined pressure and electrostatic load bias. A small amount of untransferred toner remaining on the photosensitive member 608*y* is removed and collected by the photosensitive member cleaner 609*y*, so that the photosensitive member 608*y* is prepared for the next image forming operation.

The image forming portion 613*y* described above is an image forming portion for forming a yellow (Y) image. In this embodiment (FIG. 1), the apparatus further comprises an image forming portion 613*m* for forming a magenta (M) image, an image forming portion 613*c* for forming a cyan (C) image and an image forming portion 613*k* for forming a black (Bk) image. These image forming portions 613*m*, 613*c* and 613*k* have the same constitutions and functions as those of the image forming portion 613*y* and therefore will be omitted from description. The number of colors is not limited to four, and the order of the arrangement thereof is not limited to that in this embodiment.

The intermediary transfer belt 606 which is the endless belt is supported and stretched by inner surface holding members including a driving roller 604, a steering roller 605 also functioning as a tension roller, and the secondary transfer inner roller 603 or the like and is rotationally driven in the direction indicated by an arrow n in FIG. 1. The image forming processes of the Y, M, C and Bk image forming portions 613*y*, 613*m*, 613*c* and 613*k* which are performed concurrently are executed with such a timed relation as to superimpose the image on the previous toner image transferred onto the intermediary transfer belt 606 (primary transfer). As a result, a full-color toner image is formed on the intermediary transfer belt 606 finally, and is conveyed to the secondary transfer portion T2.

In the secondary transfer portion T2, the full-color toner image is secondary-transferred onto the recording material S conveyed by the above-described process. Thereafter, the recording material S is conveyed to a fixing device 68 by a conveying portion 67. The fixing device 68 fuses and fixes the toner image on the recording material S by a predetermined pressure applied by a roller or a belt or the like and heat applied by heat source such as heater or the like.

The recording material S having the fixed image is discharged to a sheet discharge tray 600 or is refed to a reverse feeding device 601 by a branch feeding device 69. In the case of duplex image formation (images on both sides), the recording material S fed to the reverse feeding device 601 is refed into the duplex print feeding device 602 after switch-back operation with shift of the leading end to the trailing end. In timed relation with the recording material of the subsequent job fed from the recording material accommodation case 61, the recording material is fed to the secondary transfer portion T2 through a refeeding path 64*b* merging with the feeding unit 64. The image forming process for the back side (second side) is similar to that for the first side, and therefore, the detailed description thereof is omitted for simplicity.

<Intermediary Transfer Unit>

Net, an intermediary transfer unit 200 which is a belt driving apparatus for rotationally driving the intermediary transfer belt 606 which is the endless belt will be described with reference to FIGS. 2 to 4. The intermediary transfer unit 200 includes the intermediary transfer belt 606, the driving roller 604 as a driving means, the steering roller 605 as a moving means, a reference detecting sensor 2 as a reference detecting means, an edge detecting sensor 1 as an edge detecting means, and a controller C as a control means.

Figure 2:
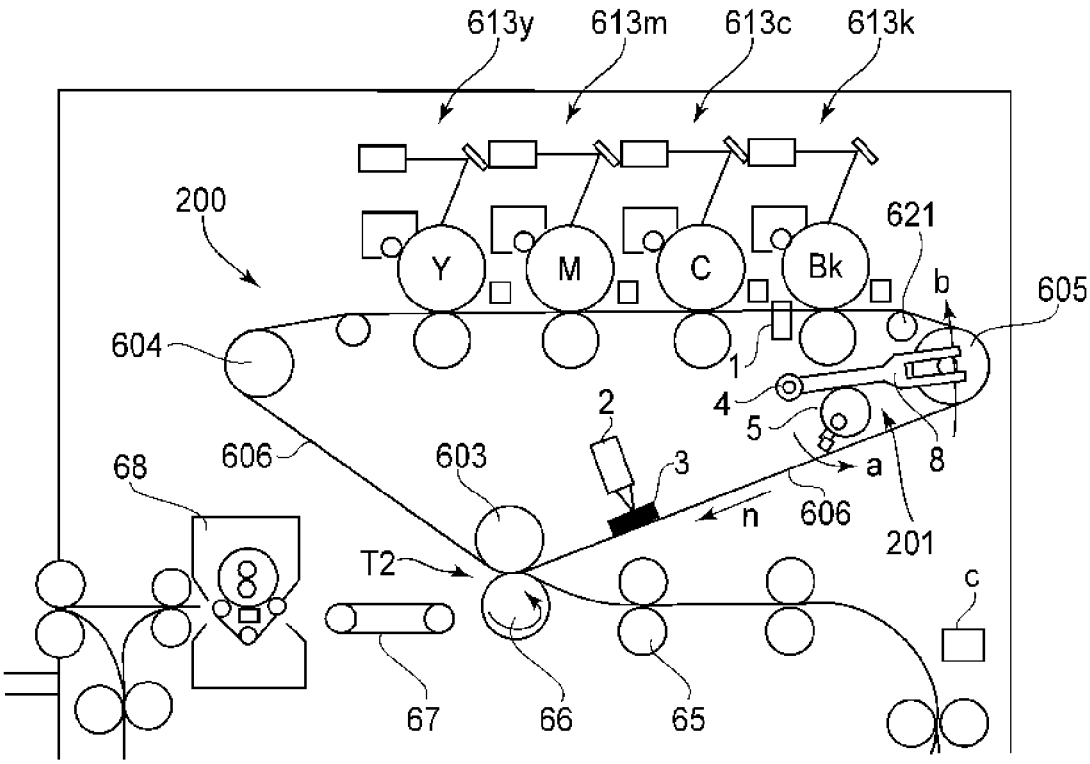
FIG. 2 is an enlarged view showing an upper half structure of the image forming apparatus shown in FIG. 1.
Figure 3:
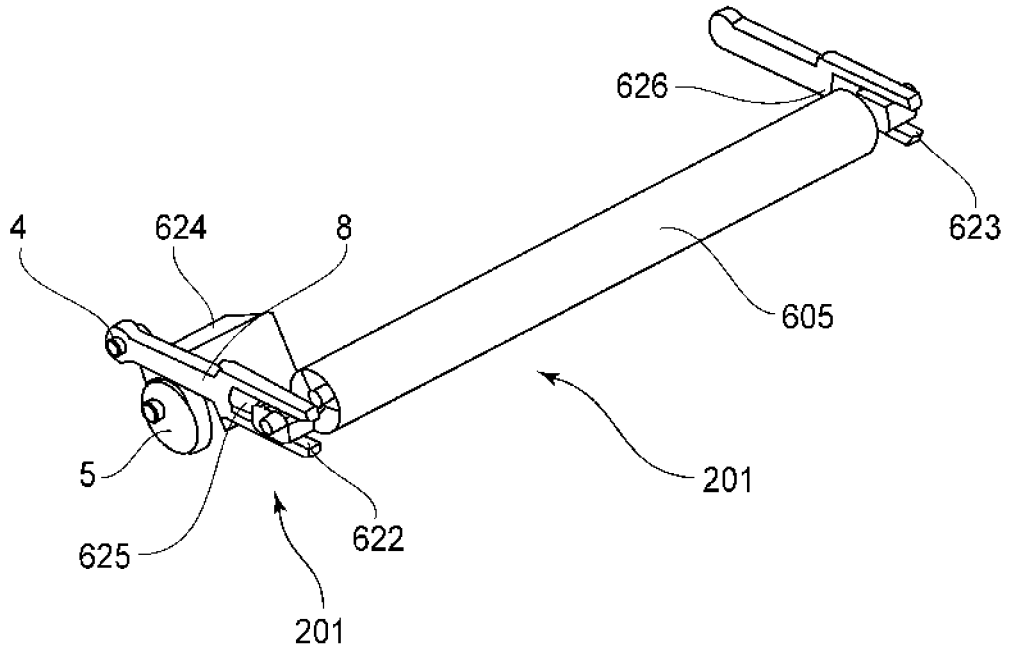
FIG. 3 is a schematic perspective view of a steering mechanism for an intermediary transfer belt.

The intermediary transfer belt 606 is, as described above, the endless belt and is stretched by the plurality of rollers, and is rotationally driven in the arrow n direction in FIG. 2 at a rotational speed (travelling speed) V by the driving roller 604 driven by an unshown driving motor. Here, the steering 605 is supported by a steering mechanism 201 as a steering roller inclination means for changing parallelism in real time in a direction crossing a belt stretching surface with respect to other inner peripheral surface holding members.

The steering mechanism 201 has the function of correcting oblique travelling of the belt during the travelling drive, i.e., so-called lateral deviation (lateral shift) of the belt. In this embodiment, as shown in FIG. 3, a steering arm 8 holds one of bearing portions 622 and 623 for supporting the steering roller 605 at both end portions. The steering arm 8 has a supporting shaft 4, as the rotation center, to which moment by an unshown urging means such as a tension spring is to be applied, thus being constituted so as to always urge a cam surface of a steering cam 5. The steering cam 5 is, e.g., mounted on a shaft of a steering motor 624 in FIG. 3 so that it can arbitrarily control a phase.

Therefore, when the steering cam 5 is rotated in an arrow a direction in FIG. 2, the steering arm 8 and the steering roller 605 are swung in the arrow b direction. On the other hand, when the steering cam 5 is driven in the direction opposite to the arrow a direction, the steering arm 8 is swung in the direction opposite to the arrow B direction.

Thus, in the steering mechanism 201 in this embodiment, the bearing portion 622 is movable relative to the fixed side bearing portion 623 of the steering roller 605, by which the axis alignment is destroyed. The variable range of the axis alignment is determined by a cam shape of the steering cam 5 and a distance from the supporting shaft 4 to the steering roller 605, and is selected properly in consideration of the maximum amount of steering required for correction of the lateral deviation of the belt.

The intermediary transfer belt is required to be stretched by a predetermined tensions. For this reason, in this embodiments, the steering roller 605 is urged in the direction crossing with the stretching surface of the intermediary transfer belt 606 by urging springs 635 and 626 shown in FIG. 3, and therefore, it functions also as a tension roller. An idler roller 621 is disposed between the photosensitive members 608*y*-608*k* and the steering roller 605, by which the belt surface of in the neighborhood of the primary transfer portion does not significantly change by the steering operation.

Figure 4:
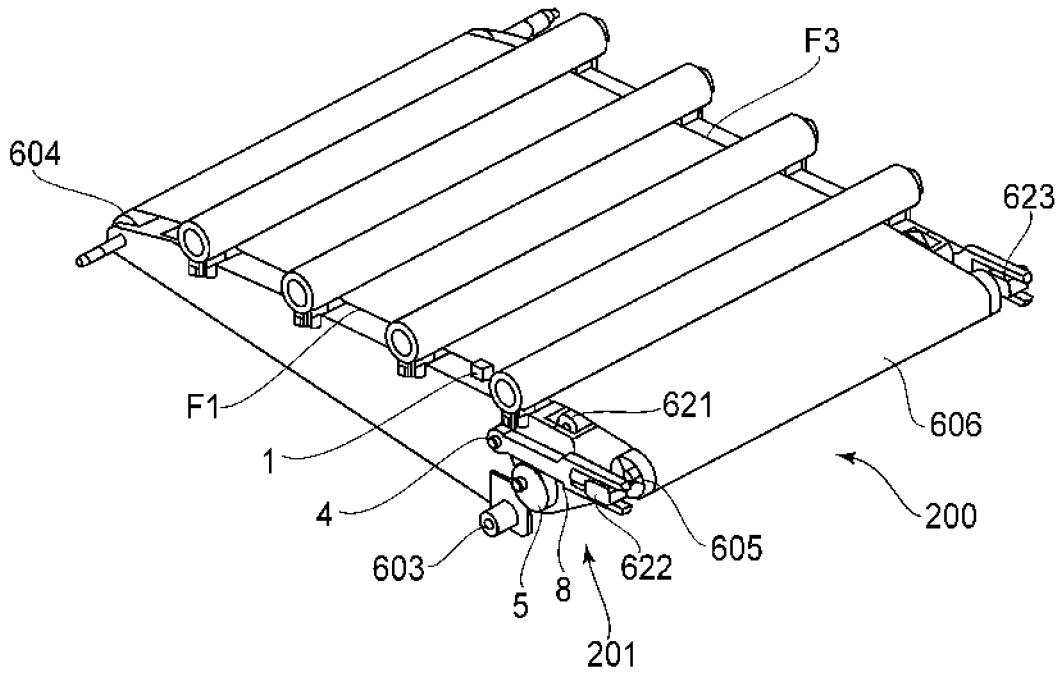
FIG. 4 is a schematic perspective view of photosensitive drums and an intermediary transfer unit.

Further, in this embodiment, as shown in FIGS. 2 and 4, the edge detecting sensor 1 detects the position of the belt in the direction crossing in (substantially perpendicular to) the rotational direction of the belt. The edge detecting sensor 1 detects the belt shape at the widthwise end portion, thus detecting the widthwise position of the belt. In this embodiment, the edge detecting sensor 1 detects an amount of tilting of the arm type contact element contacting the widthwise end portion of the belt for example by a gap sensor to detect an edge shape of the intermediary transfer belt 606, and the detected amount is converted to the movement distance of the end (that is, the amount of the lateral deviation of the belt). Incidentally, the edge detecting sensor 1 may also be, e.g., of a non-contact type using a laser, other than such a contact type. The edge detecting sensor 1 is only required to detect the shape of the belt at the widthwise end portion.

Further, as shown in FIG. 2, onto the inner peripheral surface of the intermediary transfer belt 606, a reference mark 3 (sheet-like seal or the like) constituting a reference position of the intermediary transfer belt 606 with respect to the rotational direction (circumferential direction) is applied. The reference mark 3 is detected by the reference detecting sensor 2 during the travelling of the intermediary transfer belt 606. The reference detecting sensor 2 is disposed opposed to the inner peripheral surface of the intermediary transfer belt 606 and, e.g., emits light toward the inner peripheral surface and detects its reflected light, thus detecting the reference mark 3. The position of this reference detecting sensor 2 with respect to the rotational direction of the intermediary transfer belt 606 satisfies a relationship described later.

<Edge Shape and Constitution of Intermediary Transfer Belt>

Figure 5:
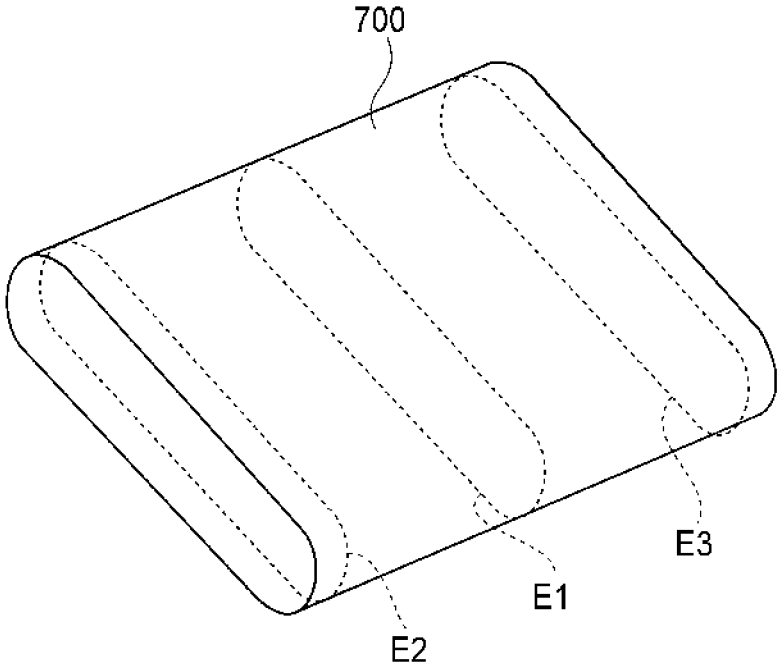
FIG. 5 is a schematic perspective view of a belt base material.

Next, with reference to FIGS. 5 to 9, details of the edge shape of the intermediary transfer belt 606 and the position of application of the reference mark 3 will be described. In the case where the intermediary transfer belt 606 is manufactured, as shown in FIG. 5, first, an endless belt base material 700 having a widthwise length more than that of the intermediary transfer belt 606 to be mounted (actually used) in the intermediary transfer unit 200 is manufactured. In this embodiment, the width of the belt base material 700 is a length which is about a little more than 2 times the width of the intermediary transfer belt 606. Further, the belt base material 700 is cut along the circumferential direction at a portion E1 indicated by a broken line in FIG. 5, by which two intermediary transfer belts can be produced by a single molding and cutting process.

Further, in the manufacturing process, in end portion regions (outside broken lines E2 and E3) of the belt base material 700, a burr or shrinkage can be generated or the thickness of the belt base material 700 with respect to the circumferential direction is unstable and causes non-uniformity in some cases. In these cases, by cutting the broken line portions E2 and E3, edge accuracy of the intermediary transfer belt 606 is ensured.

Figure 6:
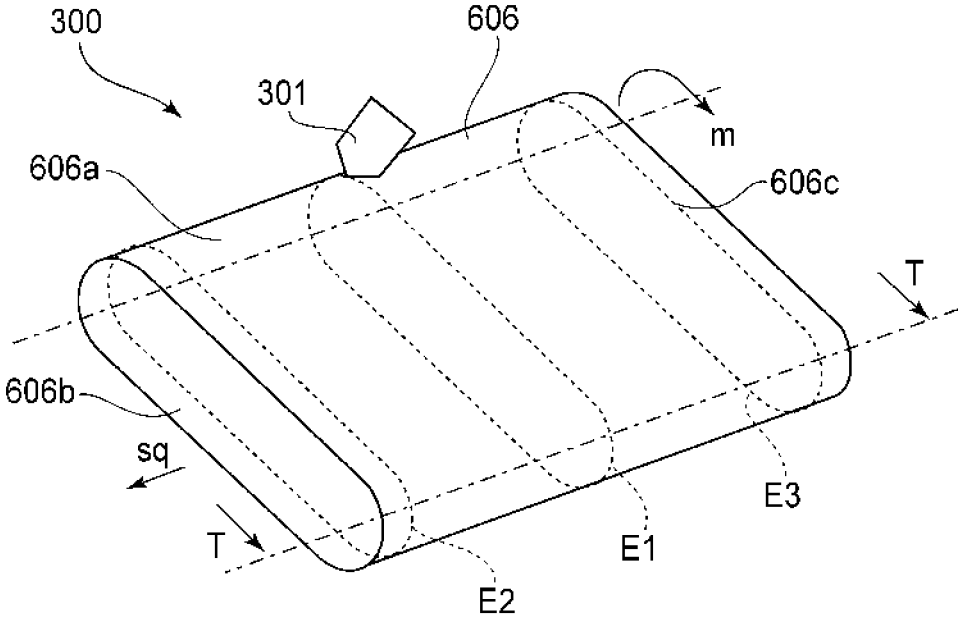
FIG. 6 is a schematic perspective view for illustrating a constitution for cutting the belt base material.

The above-described cutting of the belt base material 700 is carried out by a belt base material cutting device 300 as shown in FIG. 6. The belt base material 700 is stretched by unshown driving roller and tension roller. By the tension roller, a tension is applied to the belt base material 700 in an arrow T direction, and the belt base material 700 is driven in an arrow m direction. The cutting operation is performed by a cutter 301 as a cutting means as shown in FIG. 6 while rotating the belt base material 700 by the driving roller, and is started from an arbitrary portion C on the broken line E1 along the circumferential direction. That is, the portion C is cutting start position. Further, while rotating the belt base material 700 one full turn, the belt base material is cut by the cutter 301.

Also along the broken lines E2 and E3, a similar cutting operation is performed as needed. In this case, the cutter 301 may be provided in plurality at associated broken line positions, where the lines are cut at the same time. Alternatively, one or plural cutters are moved in the widthwise direction to successively cut these lines at their associated positions.

Figure 8:
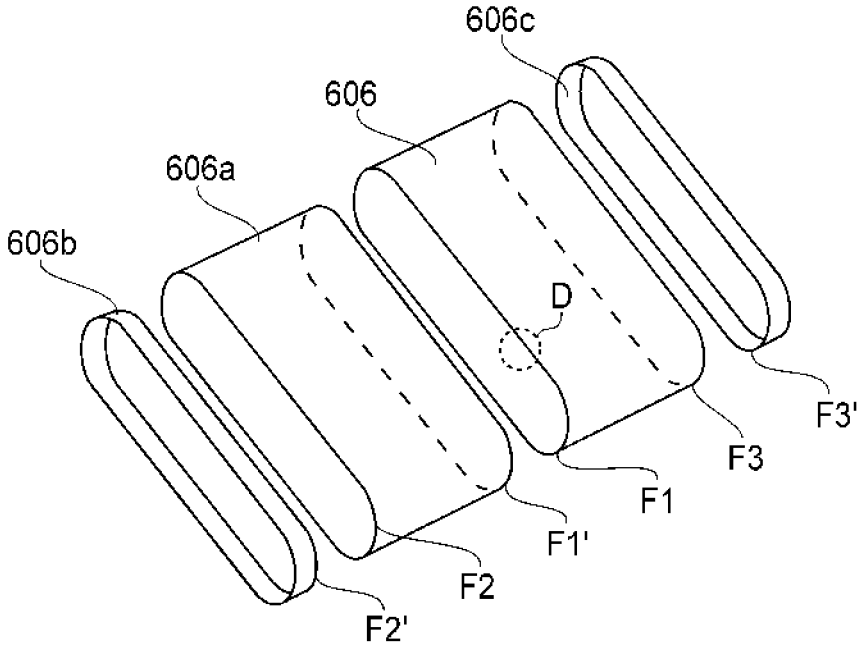
FIG. 8 is a schematic perspective view showing a state of the belt base material after the cutting.

FIG. 8 shows a state after the belt base material 700 is cut along the broken lines E1, E2 and E3. The belt base material 700 shown in FIG. 5 is cut in the above-described manner, so that two intermediary transfer belts 606 and 606*a* are provided as shown in FIG. 8. The thus-manufactured intermediary transfer belts 606 and 606*a* are provided with edge shapes F1 and F3, and F1' and F2, respectively, as shown in FIG. 8.

Figure 7:
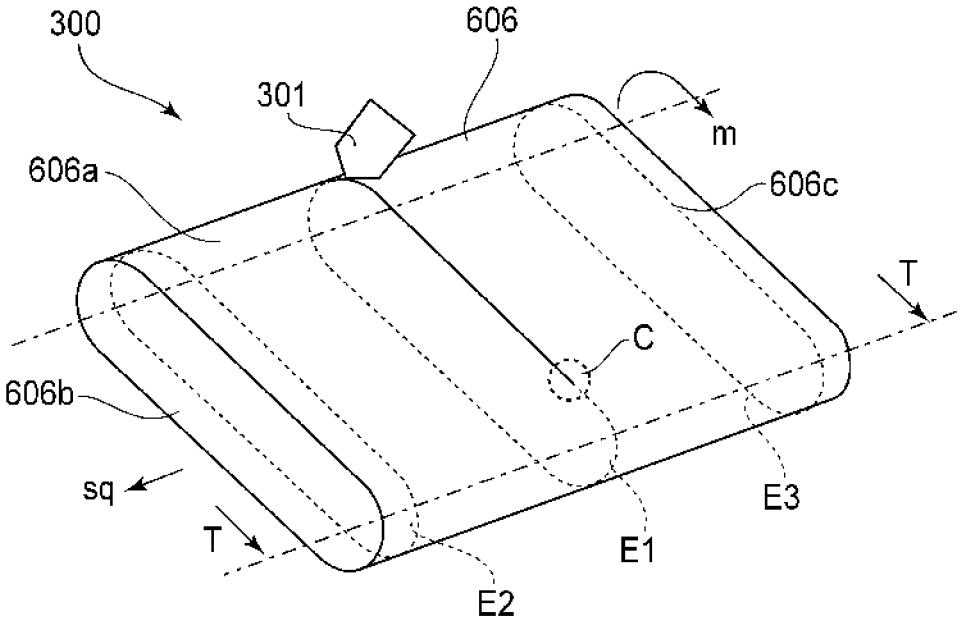
FIG. 7 is a schematic perspective view, similar to FIG. 6, showing a state of cutting of the belt base material in midstream.
Figure 9:
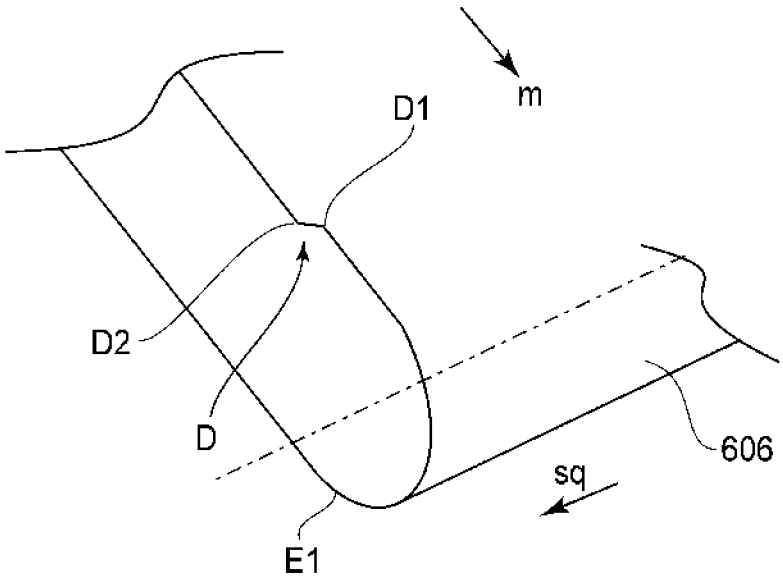
FIG. 9 is a schematic perspective view showing a stepped portion present at a belt end portion with respect to a widthwise direction of the belt in an enlarged manner.

Here, when the belt base material 700 is cut while being driven and travelled as shown in FIG. 7, a lateral deviation operation is generated due to misalignment or the like of the stretching rollers, such as the driving roller and the tension roller, for stretching the belt base material 700. With respect to this lateral deviation operation, an amount of the lateral deviation is intended to be suppressed by adjusting of the apparatus or the like but it is difficult to make the lateral deviation amount zero. For this reason, when the belt base material 700 is rotationally driven for being cut, the belt base material 700 is shifted in an arrow sq direction in FIG. 7. Thus, as shown in FIG. 9, a deviation occurs between widthwise positions of a cutting start position D1 and a cutting end portion D2. As a result, in the edge shape F1 of one full circumference of the intermediary transfer belt 606, a stepped portion D is generated.

Figure 10:
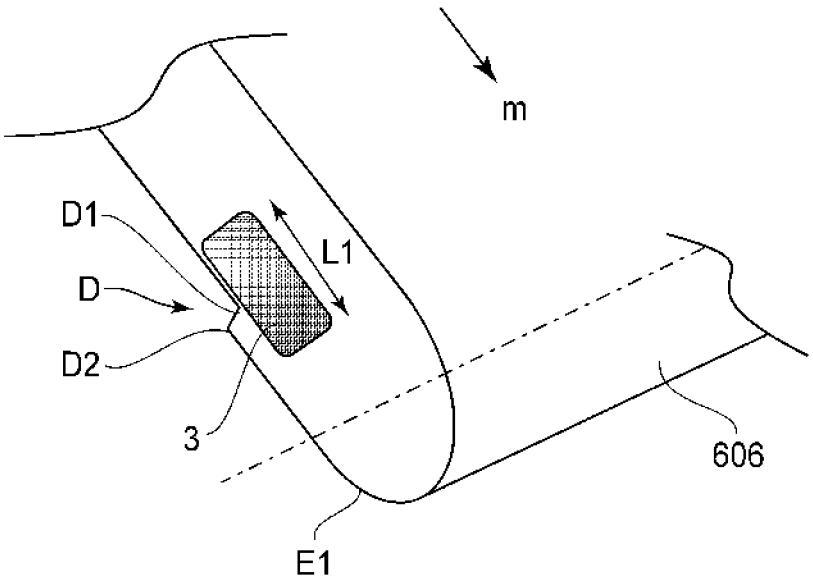
FIG. 10 is a schematic perspective vie showing a reference mark provided so as to extend over the stepped portion of the belt and its periphery in an enlarged manner.

In this embodiment, at a position corresponding to the stepped portion D generated during the manufacturing process, as shown in FIG. 10, the reference mark 3 which is a mark for identifying the position of the stepped portion D is provided. That is, on the inner peripheral surface of the intermediary transfer belt 606, the reference mark 3 is provided so as to extend over the stepped portion D (cutting start position D1 and cutting end position D2), with respect to the rotational direction, present at the widthwise end portion. The length of this reference mark 3 with respect to the rotational direction is longer than that of the stepped portion D with respect to the rotational direction, and has a predetermined range L1. Therefore, the stepped portion D is located within the predetermined range L1 with respect to the rotational direction.

Such a reference mark 3 may be provided by applying the seal or may also be provided by directly applying paint. Further, a magnet may also be applied to the intermediary transfer belt 606, so that magnetism may be detected. In either case, the reference mark 3 is provided and then is detected by the reference detecting sensor 2, so that the position of the stepped portion D can be identified. The reference mark 3 may be provided at least at a trailing end of the predetermined range L1. Further, in order to identify the position of the stepped portion D, the mark may only be required to be present at a position providing a clear positional relationship with the stepped portion D. For example, the mark may also be provided at a position deviated from the stepped portion D by a predetermined length with respect to the circumferential direction of the belt.

<Steering Control and Belt Edge Detection>

Figure 11:
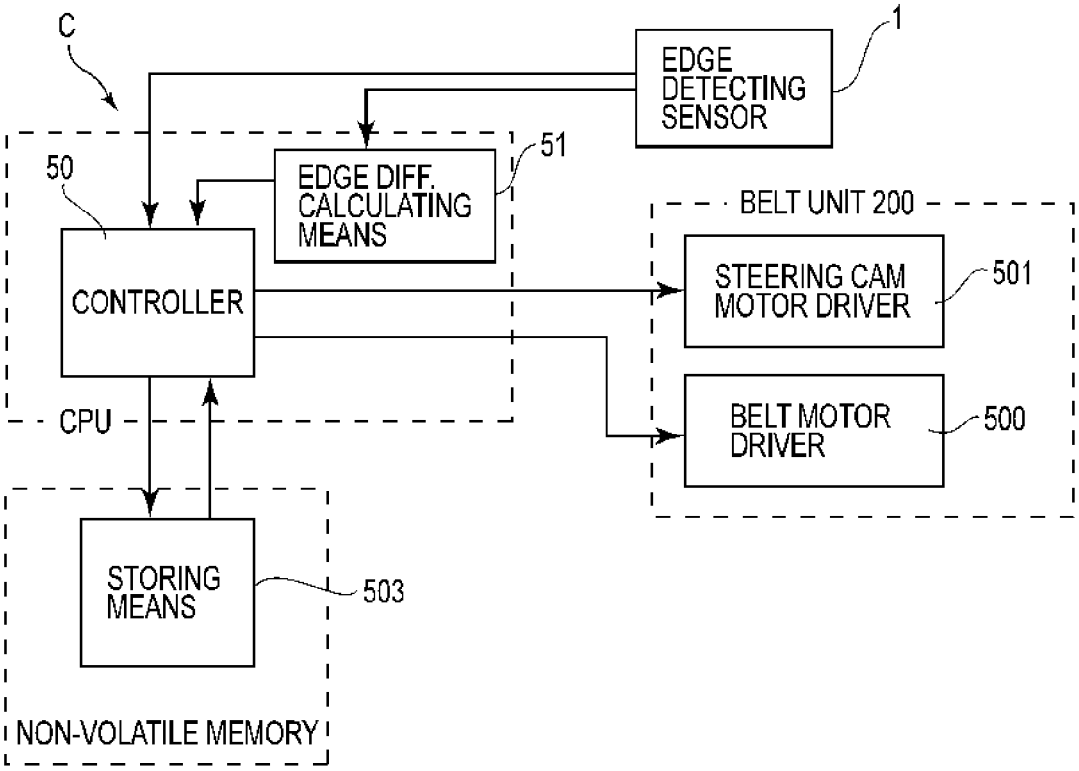
FIG. 11 is a block diagram of lateral deviation control of the belt.

Next, with reference to FIGS. 11 to 14, steering control for correcting the lateral deviation of the belt and belt edge detection in this embodiment will be described. As shown in FIG. 11, the controller C in this embodiment calculates, from a detection result of the edge detecting sensor 1, a difference from a target edge position set in advance by a belt edge difference calculating means 51, so that a control portion 50 controls the intermediary transfer unit 200.

The target edge position is determined on the basis of a profile of an edge shape obtained by sampling the edge of the intermediary transfer belt 606 by the edge detecting sensor 1. That is, this profile is stored in a storing means 503, and a difference thereof with a profile of the belt edge shape detected during actual lateral deviation control is calculated. Then, on the basis of this difference, the lateral deviation control is effected so that the belt is moved to the target position.

Further, the sampling is made in a set sampling period after a reference position of the intermediary transfer belt 606 is detected by the reference detecting sensor 2 but in this embodiment, the reference position in an end of the reference mark 3 (predetermined range L1) with respect to the rotational direction. That is, when the reference detecting sensor 2 detects the rotational direction end (trailing end in this embodiment) of the reference mark 3, the belt edge is detected by the edge detecting sensor 1 in the sampling period set below. Further, the sampling period is reset every one full circumference, i.e., every detection of the trailing end of the reference mark 3 with respect to the rotational direction by the reference detecting sensor 2.

In this embodiment, in such belt edge detection, the sampling by the edge detecting sensor 1 is effected plural times every one full circumference of the intermediary transfer belt 606 but an detection interval (sampling period) Ts is set in the following manner. That is, the sampling period is, on the basis of the timing when the reference detecting sensor 2 detects the reference mark 3 as the reference position, set so that the detection by the edge detecting sensor 1 is performed at a position deviated from the stepped portion D.

Figure 12:
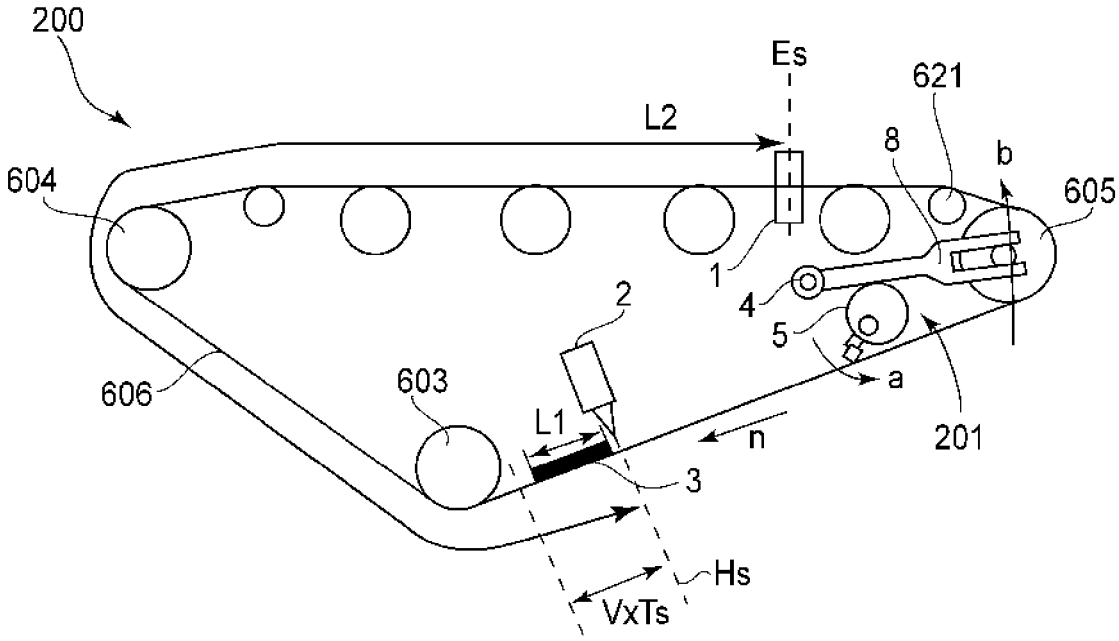
FIG. 12 is a schematic sectional vie of a structure of the intermediary transfer unit.

Specifically, the sampling period is set as follows. As shown in FIG. 12, a length (predetermined range) of the reference mark 3 with respect to the circumferential direction is L1, a rotational speed of the intermediary transfer belt 606 in the arrow n direction is V, and a circumferential length from a detection position Hs of the reference detecting sensor 2 to a detection position Es of the edge detecting sensor 1 is L2. In other words, L2 is a length of the intermediary transfer belt 606, from the reference detecting sensor 2 to the edge detecting sensor 1, passing through the secondary transfer inner roller 603 and the driving roller 604 with respect to the rotationally rotational direction n. Further, at the time when the reference detecting sensor 2 detects the rotational direction end of the reference mark 3, the edge detecting sensor 1 starts the detection.

In this case, the above-described factors are set to satisfy the following two relational expressions. Incidentally, K is a natural number.

$$L1 \leq V \times Ts$$

$$L2 = K \times (V \times Ts)$$

That is, the sampling period Ts, a positional relationship between the edge detecting sensor 1 and the reference detecting sensor 2, the circumferential length L1 of the reference mark 3, and the like are properly set so as to satisfy the above relational expressions. Specifically, when the positional relationship (L2) between the edge detecting sensor 1 and the reference detecting sensor 2 and the rotational speed V of the intermediary transfer belt 606 are determined, the sampling period is set correspondingly to the length L1 of the reference mark 3 with respect to the circumferential direction.

The rotational direction length L1 of the reference mark 3 is made not more than the sampling interval (V×Ts), so that the sampling is carried out before or after the stepped portion D present within the range of the reference mark 3. Further, the distance between the reference detecting sensor 2 and the edge detecting sensor 1 is set at a natural number multiple of the sampling interval. As a result, when the edge detecting sensor 1 starts the detection with timing when the reference detecting sensor 2 detects the rotational direction trailing end of the reference mark 3, the edge detecting sensor 1 does not detect the stepped portion D in the above-described sampling interval. The position of the detected reference mark 3 may also be a leading end with respect to the rotational direction.

Figure 13:
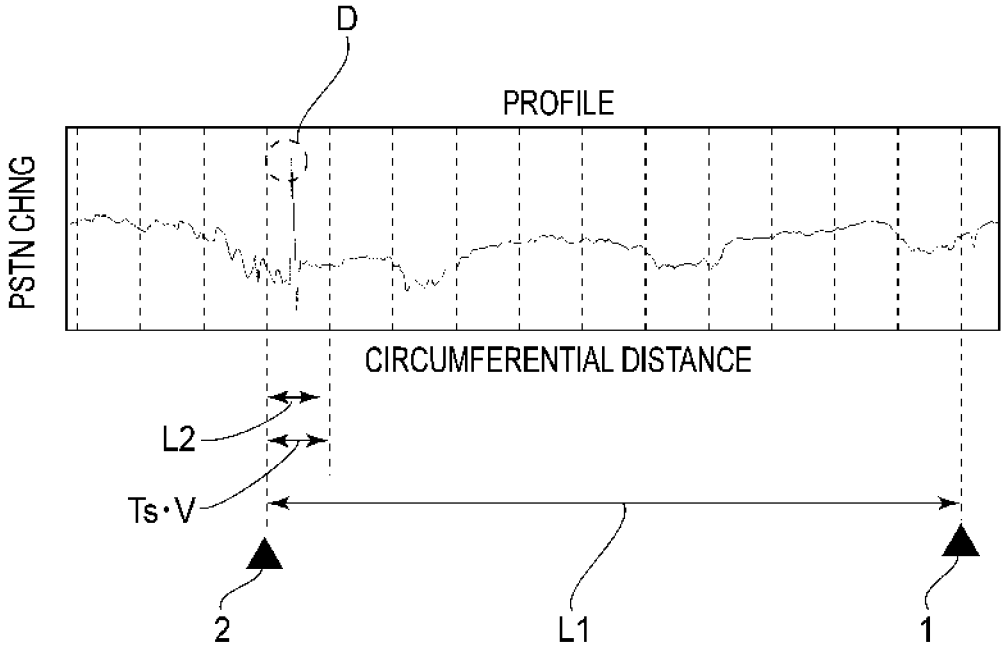
FIG. 13 is a schematic diagram showing an obtained profile and sampling interval at the widthwise end portion of the belt.

For example, when K=11 is set, the sampling by the edge detecting sensor 1 is made with timing indicated by broken lines in FIG. 13. That is, in response to the detection of the trailing end of the reference mark 3 by the reference detecting sensor 2, obtaining of the edge shape F1 of the intermediary transfer belt 606 is started and therefore the edge detecting sensor 1 does not detect the stepped portion D.

Incidentally, the sampling period is also not required to satisfy the above-described relational expressions when the timing when the edge detecting sensor 1 starts the detection is deviated from the timing when the reference detecting sensor 2 detects the rotational direction trailing end of the reference mark 3. For example, in the case where the edge detecting sensor 1 starts the detection after a lapse of a predetermined time from the detection by the reference detecting sensor 2, the sampling period is set in consideration of this predetermined time.

Figure 14:
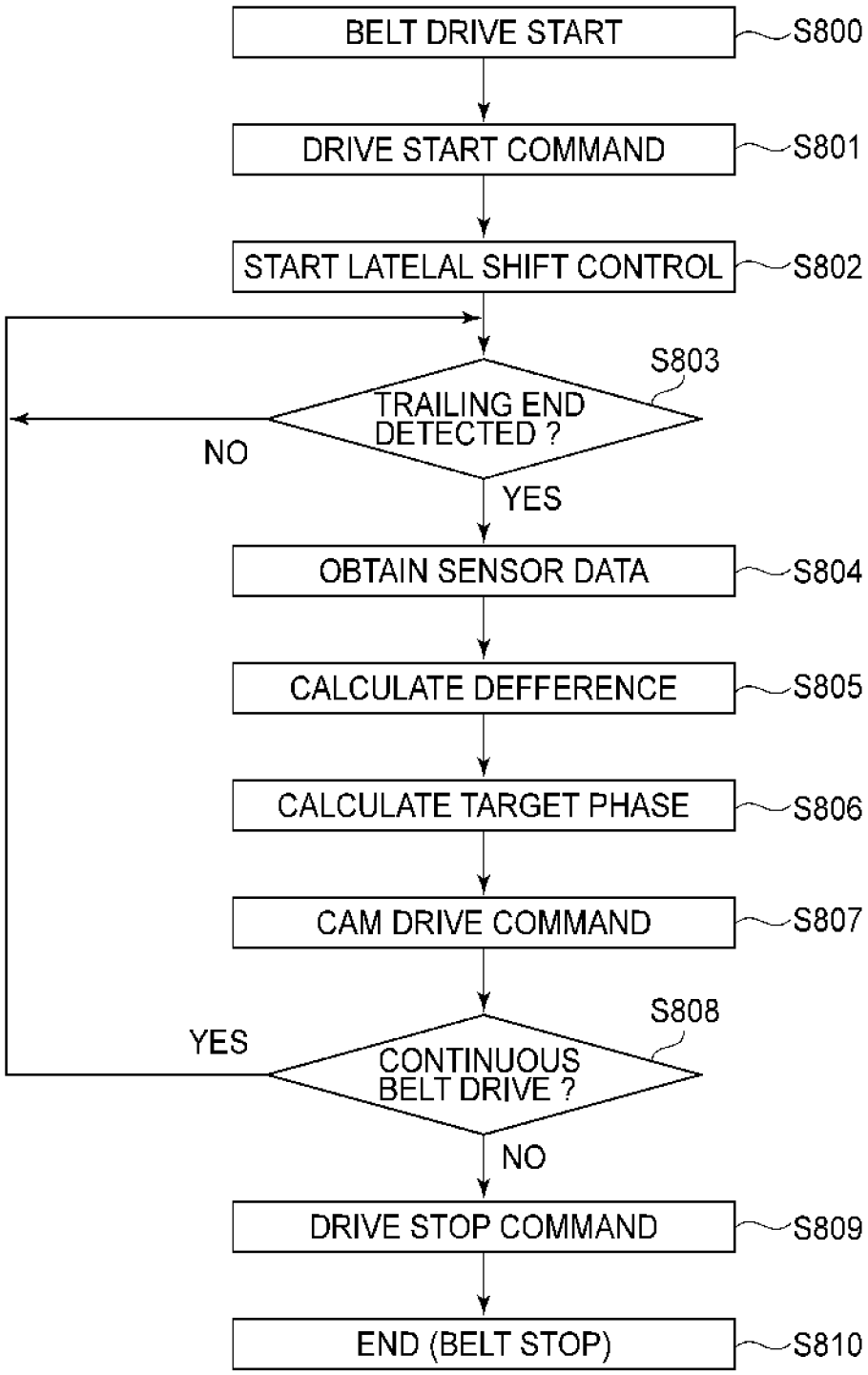
FIG. 14 is a flow chart of the lateral deviation control of the belt.
Figure 15:
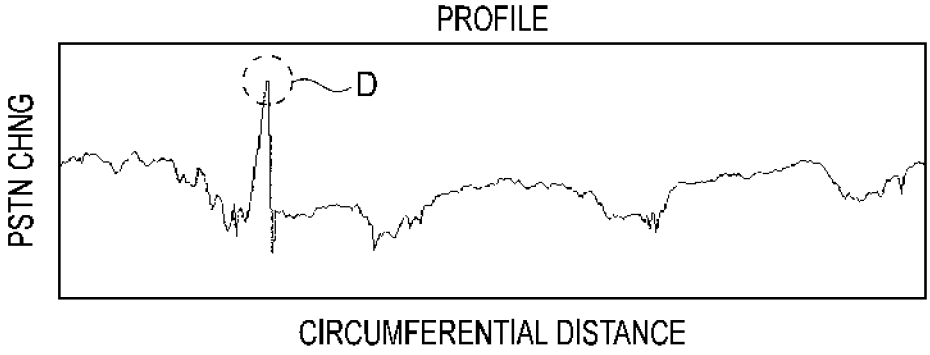
FIG. 15 is a schematic diagram showing a profile obtained by an edge detecting sensor at the widthwise end portion of the belt.
Figure 16:
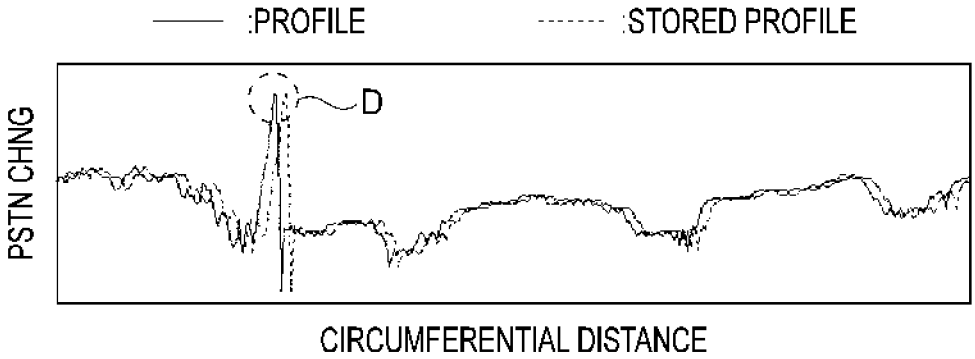
FIG. 16 is a schematic diagram showing a state in which the obtained profile at the widthwise end portion of the belt and a stored profile are deviated in a time axis.
Figure 17:
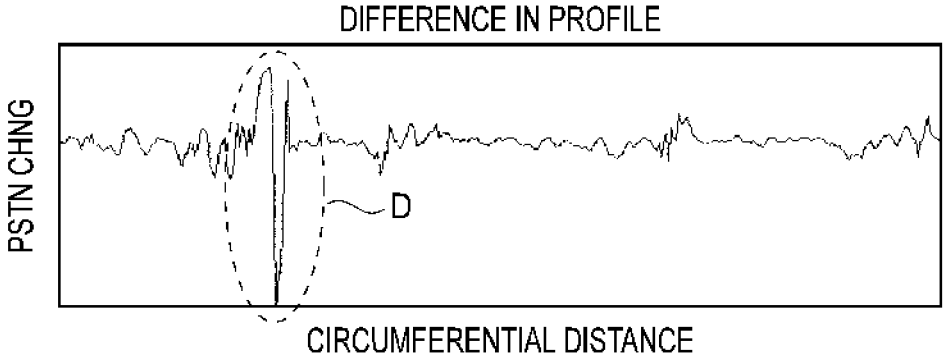
FIG. 17 is a schematic diagram showing a difference between the obtained profile and the stored profile.

A flow of the above-described steering control and belt edge detection in this embodiment will be described with reference to FIG. 14.

First, when the start of drive of the intermediary transfer belt 606 is instructed in the image formation mode or various image adjusting modes (S800), a drive start command is sent to a belt drive motor driver 700 from the controller (control portion) 50 of FIG. 11 (S801). Then, the lateral deviation control of the belt is started by the steering mechanism 201 (S802). When the reference detecting sensor 2 detects the trailing end of the reference mark 3 on the inner peripheral surface of the intermediary transfer belt 606 (YES of S803), the controller 50 obtains belt edge positional data from the belt edge sensor 1 in the sampling period Ts (S804).

Then, a difference from a preset target edge position is calculated by a belt edge difference calculating means 51 (S805). The controller 50 calculates a target phase of the steering cam 5 in accordance with a predetermined PID control, using the result of the plurality (N) of detections of the edge detecting sensor 1 (belt position detecting means) (S806). In response to the target phase, a drive command is sent to a steering cam drive motor driver 501 (S807). Thereafter, the operations from S803 to S807 are repeated normally at predetermined control intervals during driving operation of the intermediary transfer belt 606 (S808). When the image formation or the image adjusting mode operations are completed, a drive stop instruction is sent to the belt drive motor driver (S809), and the rotation of the intermediary transfer belt 606 stops (S810).

In this embodiment, during the obtaining of the data of the edge shape F1, there is no need to make the sampling in the neighborhood of the stepped portion D. For this reason, noise of the stepped portion D is prevented from being incorporated in the obtained data of the edge shape, so that the lateral deviation amount of the intermediary transfer belt 606 can be detected with high accuracy. For this reason, it is possible to prevent a lowering in lateral deviation accuracy caused by the presence of the stepped portion D. As a result, during the drive of the intermediary transfer belt 606, stable steering control (lateral deviation control) can be effected, so that image accuracy in terms of color misregistration in a main scan direction or the like can be improved.

Further, compared with the conventional constitution, there is no additional part or the like and therefore, the function can be improved with no increase is cost. Further, in the constitution in this embodiment, the position of the stepped portion generated by the cutting can be recognized with reliability and therefore an operation time required for recognizing the stepped portion can be reduced, so that it becomes possible to realize further improvement in productivity and further speed-up.

Other Embodiment

In the above embodiment, the case where a single stepped portion is present at the edge of the belt is described but the present invention is also applicable to even the case where there are a plurality of stepped portions. In this case, the plurality of stepped portions are identified and associated marks are provided. Then, on the basis of a detection result of the marks, the sampling period of the edge detection is set. For examples, the respective factors are set to satisfy the above-described relational expressions for L1 and L2 with respect to each of the stepped portions. At that time, L2 is set in interrelation with a positional with each of the stepped portions.

In the above-described embodiment, the case where the present invention is applied to the image forming apparatus of the intermediary transfer type is described but the present invention is also applicable to a type in which the toner image is directly transferred from the image bearing member such as the photosensitive member onto the recording material conveyed by a recording material conveyance belt. In this case, lateral deviation control of the recording material conveyance belt is effected in the same manner as that in the above-described embodiment.

Further, the present invention is also applicable to a structure using the endless belt in the fixing device, in addition to the driving apparatus for the intermediary transfer belt or the recording material conveyance belt. Further, also in an image forming apparatus other than the image forming apparatus described above, the present invention may preferably be applied to control by using the belt driving apparatus including the endless belt to be rotationally driven.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 190724/2011 filed Sep. 1, 2011, which is hereby incorporated by reference.

What is claimed is:

1. A belt driving apparatus comprising:

an endless belt having a stepped region at an edge;

a driving member for rotationally driving said endless belt;

a moving member for moving said endless belt in a widthwise direction of said endless belt;

a mark provided at a part of said endless belt with respect to a circumferential direction and located at a position corresponding to the stepped region of said endless belt with respect to a rotational direction of said endless belt;

a mark detecting member for detecting said mark during rotation of said endless belt;

an edge position detecting member for detecting a widthwise position of at least one edge of said endless belt during rotation; and a controller for controlling, after said mark detecting member detects said mark, said moving member on the basis of a detection result of the edge other than the stepped region of said endless belt.

2. An apparatus according to claim 1, wherein said mark is provided so that its length is longer than that of the stepped region with respect to the rotational direction of said endless belt and so that said mark includes the stepped region, and wherein said controller starts control of said moving member after said mark detecting member detects an end portion of said mark with respect to the rotational direction.

3. An apparatus according to claim 2, wherein $$L1 \leq V \times Ts \text{ and}$$

$$L2 = K \times (V \times Ts)$$

are satisfied when an interval in which the control of said moving member is effected is Ts, a rotational speed of said endless belt is V, a length of said mark with respect to the rotational direction is L1, a distance from said mark detecting member to said edge position detecting member with respect to the rotational direction is L2, and a natural number is K.

4. An apparatus according to claim 1, wherein said endless belt is prepared by cutting an endless belt base material, having a length longer than that of said endless belt, along the circumferential direction, and wherein the stepped region is a region between a cutting start position and a cutting end position with respect to the circumferential direction.

5. An apparatus according to claim 1, wherein said endless belt has a plurality of stepped regions corresponding to said mark, and wherein said controller controls, after said mark detecting member detects said mark, said moving member on the basis of a detection result of the edge other than the stepped regions of said endless belt.

6. A belt driving apparatus comprising:

an endless belt having a stepped region at an edge;

a driving member for rotationally driving said endless belt;

a moving member for moving said endless belt in a widthwise direction of said endless belt;

a mark provided at a part of said endless belt with respect to a circumferential direction and spaced by a predetermined distance from the stepped region of said endless belt with respect to a rotational direction of said endless belt;

a mark detecting member for detecting said mark during rotation of said endless belt;

an edge position detecting member for detecting a widthwise position of at least one edge of said endless belt during rotation;

a storing portion for storing a relationship between a distance of said endless belt from said mark with respect to the rotational direction and a position of the edge with respect to the widthwise direction; and a controller for controlling, after said mark detecting member detects said mark, said moving member on the basis of a detection result of the edge other than the stepped region of said endless belt and the relationship stored in said storing portion.

7. An image forming apparatus comprising:

an image bearing member for bearing a toner image;

an intermediary transfer belt, having a stepped region at an edge, onto which the toner image is to be transferred from said image bearing member;

a transfer member for transferring the toner image from said intermediary transfer belt onto a recording material;

a driving member for rotationally driving said intermediary transfer belt;

a moving member for moving said intermediary transfer belt in a widthwise direction of said intermediary transfer belt;

a mark provided at a part of said intermediary transfer belt with respect to a circumferential direction and located at a position corresponding to the stepped region of said intermediary transfer belt with respect to a rotational direction of said intermediary transfer belt;

a mark detecting member for detecting said mark during rotation of said intermediary transfer belt;

an edge position detecting member for detecting a widthwise position of at least one edge of said intermediary transfer belt during rotation; and a controller for controlling, after said mark detecting member detects said mark, said moving member on the basis of a detection result of the edge other than the stepped region of said intermediary transfer belt.

8. An apparatus according to claim 7, wherein said mark is provided so that its length is longer than that of the stepped region with respect to the rotational direction of said intermediary transfer belt and so that said mark includes the stepped region, and wherein said controller starts control of said moving member after said mark detecting member detects an end portion of said mark with respect to the rotational direction.

9. An apparatus according to claim 8, wherein $$L1 \leq V \times Ts \text{ and}$$

$$L2 = K \times (V \times Ts)$$

are satisfied when an interval in which the control of said moving member is effected is Ts, a rotational speed of said intermediary transfer belt is V, a length of said mark with respect to the rotational direction is L1, a distance from said mark detecting member to said edge position detecting member with respect to the rotational direction is L2, and a natural number is K.

10. An apparatus according to claim 7, wherein said intermediary transfer belt is prepared by cutting an endless belt base material, having a length longer than that of said intermediary transfer belt, along the circumferential direction, and wherein the stepped region is a region between a cutting start position and a cutting end position with respect to the circumferential direction.

11. An apparatus according to claim 7, wherein said intermediary transfer belt has a plurality of stepped regions corresponding to said mark, and wherein said controller controls, after said mark detecting member detects said mark, said moving member on the basis of a detection result of the edge other than the stepped regions of said intermediary transfer belt.

12. An image forming apparatus comprising:

an image bearing member for bearing a toner image;

an intermediary transfer belt, having a stepped region at an edge, onto which the toner image is to be transferred from said image bearing member;

a transfer member for transferring the toner image from said intermediary transfer belt onto a recording material;

a driving member for rotationally driving said intermediary transfer belt;

a moving member for moving said intermediary transfer belt in a widthwise direction of said intermediary transfer belt;

a mark provided at a part of said intermediary transfer belt with respect to a circumferential direction and located at a position corresponding to the stepped region of said intermediary transfer belt with respect to a rotational direction of said intermediary transfer belt;

a mark detecting member for detecting said mark during rotation of said intermediary transfer belt;

an edge position detecting member for detecting a widthwise position of at least one edge of said intermediary transfer belt during rotation;

a storing portion for storing a relationship between a distance of said intermediary transfer belt from said mark with respect to the rotational direction and a position of the edge with respect to the widthwise direction; and a controller for controlling, after said mark detecting member detects said mark, said moving member on the basis of a detection result of the edge other than the stepped region of said intermediary transfer belt and the relationship stored in said storing portion.

13. An image forming apparatus comprising:

an image bearing member for bearing a toner image;

a recording material conveyance belt having a stepped region at an edge, for conveying a recording material;

a transfer member for transferring the toner image from said image bearing member onto a recording material conveyed by said recording material conveyance belt;

a driving member for rotationally driving said recording material conveyance belt;

a moving member for moving said recording material conveyance belt in a widthwise direction of said recording material conveyance belt;

a mark provided at a part of said recording material conveyance belt with respect to a circumferential direction and located at a position corresponding to the stepped region of said recording material conveyance belt with respect to a rotational direction of said recording material conveyance belt;

a mark detecting member for detecting said mark during rotation of said recording material conveyance belt;

an edge position detecting member for detecting a widthwise position of at least one edge of said recording material conveyance belt during rotation; and a controller for controlling, after said mark detecting member detects said mark, said moving member on the basis of a detection result of the edge other than the stepped region of said recording material conveyance belt.

14. An apparatus according to claim 13, wherein said mark is provided so that its length is longer than that of the stepped region with respect to the rotational direction of said recording material conveyance belt and so that said mark includes the stepped region, and wherein said controller starts control of said moving member after said mark detecting member detects an end portion of said mark with respect to the rotational direction.

15. An apparatus according to claim 14, wherein $$L1 \leq V \times Ts \text{ and}$$

$$L2 = K \times (V \times Ts)$$

are satisfied when an interval in which the control of said moving member is effected is Ts, a rotational speed of said recording material conveyance belt is V, a length of said mark with respect to the rotational direction is L1, a distance from said mark detecting member to said edge position detecting member with respect to the rotational direction is L2, and a natural number is K.

16. An apparatus according to claim 13, wherein said recording material conveyance belt is prepared by cutting an endless belt base material, having a length longer than that of said recording material conveyance belt, along the circumferential direction, and wherein the stepped region is a region between a cutting start position and a cutting end position with respect to the circumferential direction.

17. An apparatus according to claim 13, wherein said recording material conveyance belt has a plurality of stepped regions corresponding to said mark, and wherein said controller controls, after said mark detecting member detects said mark, said moving member on the basis of a detection result of the edge other than the stepped regions of said recording material conveyance belt.

18. An image forming apparatus comprising:

an image bearing member for bearing a toner image;

a recording material conveyance belt, having a stepped region at an edge, for conveying a recording material;

a transfer member for transferring the toner image from said image bearing member onto a recording material conveyed by said recording material conveyance belt;

a driving member for rotationally driving said recording material conveyance belt;

a moving member for moving said recording material conveyance belt in a widthwise direction of said recording material conveyance belt;

a mark provided at a part of said recording material conveyance belt with respect to a circumferential direction and located at a position corresponding to the stepped region of said recording material conveyance belt with respect to a rotational direction of said recording material conveyance belt;

a mark detecting member for detecting said mark during rotation of said recording material conveyance belt;

an edge position detecting member for detecting a widthwise position of at least one edge of said recording material conveyance belt during rotation;

a storing portion for storing a relationship between a distance of said recording material conveyance belt from said mark with respect to the rotational direction and a position of the edge with respect to the widthwise direction; and a controller for controlling, after said mark detecting member detects said mark, said moving member on the basis of a detection result of the edge other than the stepped region of said intermediary transfer belt and the relationship stored in said storing portion.

* * * * *